United States Patent [19]

DeFelice

[11] Patent Number: 5,071,060

[45] Date of Patent: Dec. 10, 1991

[54] PLASTIC TUMBLER

[76] Inventor: Amedio DeFelice, 251 Florence St., Leominster, Mass. 01453

[21] Appl. No.: 677,506

[22] Filed: Mar. 29, 1991

[51] Int. Cl.[5] ..... B65D 1/40

[52] U.S. Cl. ..... 229/1.5 B; 220/675

[58] Field of Search ..... 229/1.5 B, 3.5 R; 220/669, 675

[56] References Cited

U.S. PATENT DOCUMENTS

| | | | |
|---|---|---|---|
| 3,033,434 | 5/1962 | Carson | 220/669 |
| 3,169,689 | 2/1965 | Schwartz | 229/3.5 R |
| 3,237,834 | 3/1966 | Davis et al. | 229/1.5 B |
| 4,261,501 | 4/1981 | Watkins et al. | 229/1.5 B |
| 4,446,969 | 5/1984 | Tyler | 229/1.5 B |

FOREIGN PATENT DOCUMENTS

| | | | |
|---|---|---|---|
| 1038897 | 8/1966 | United Kingdom | 229/1.5 B |
| 1366310 | 9/1974 | United Kingdom | 229/1.5 B |

*Primary Examiner*—Gary E. Elkins
*Attorney, Agent, or Firm*—Charles R. Fay

[57] ABSTRACT

A water tumbler or the like having a smooth interior and ribs on the exterior, the ribs extending in spaced relation from top to bottom of the tumbler and being deeper at a central area vertically of the tumbler to disperse heat or cold from the surface of the outside of the tumbler.

3 Claims, 1 Drawing Sheet

PLASTIC TUMBLER

BACKGROUND OF THE INVENTION

Molded plastic water tumblers, highball glasses, etc., of whatever size or shape, are being used to a great extent, and a consideration the manufacturer faces, of course, is the thickness and material of the receptacle. Especially when made with a relatively thin wall, the heat or cold of the contents is quickly passed through the side wall to the discomfort of the user. This application for patent relates to means to alleviate this problem without merely thickening the side wall, which is done to present an answer to this problem, i.e., using styrofoam. The present container may be used to obviate the use of styrofoam in this instance.

SUMMARY OF THE DISCLOSURE

The manufacturer of the container described will choose a suitable plastic for injection molding with the heat and cold insulation desired. This novel insulation includes vertical ribs on the outside surface or aspect of the container. These ribs are mutually circumferentially spaced all around the container, and are preferably triangular in cross-section with bases on the container surface, integral therewith, and termination in blunt edges. The ribs do not touch each other and are of tapering shape in an up and down direction, being deepest at an intermediate location and tapering down to zero or thereabouts at the ends. The ends are located at the bottom ends, near the bottom of the containers and at the upper ends near the lips or rims of the open ends of the container. Thus the ribs are greatest at the central parts of the containers where the user's hand will naturally grasp the container, and the greatest insulative effect is obtained where wanted, with the minimum of material needed.

PREFERRED EMBODIMENT OF THE INVENTION

This invention has been illustrated in the form and shape of an ordinary water tumbler, but it is to be understood that other shapes such as highball glasses, old fashion glasses, beer containers, are also covered, as well as different shapes, as oval, square, etc. glasses and such containers and receptacles. The invention lies in ribs 10 on the outside surface or aspect of the ribbed containers, the inside surfaces or aspects of the containers being smooth. The container itself is indicated at 12, the side wall 14 is continuous, and the container has an open top and a closed bottom 16. Variations can be made, such as the clear band 18 at the bottom and 20 at the top, and the ribs 10 may extend between these top and bottom bands, but other configurations are possible without going beyond the inventive concept.

The container side wall 14 may be of substantial evenness in thickness from top to bottom and is slightly convex shape at the inside of the container and corresponding concavity at the outside, in the vertical direction. That is the side wall of the container is formed on short arcs of circles having their centers horizontal. The side wall also is not exactly perpendicular to the bottom and plane of the top at least in the upper part of the container where the side wall flares or gradually widens a small amount, see particularly FIG. 2. The lower portion of the container does not flare and extends from the upper flared part smoothly. In fact the lower part of the container flares very little or not at all.

The ribs are molded integrally with the containers and the inner edge of each rib is convex as it extends from the concave outer aspect of the side wall. But the ribs are substantially straight edged at the opposite edges thereof, so that each rib is greatest in depth in the central area thereof and gradually tapers or narrows down toward the upper and lower ends. This construction therefore protects the hand of the user best in the central area, vertically speaking of the container, and this is the usual place or area where the user grasps the hot or cold receptacle or container.

Figure 1:
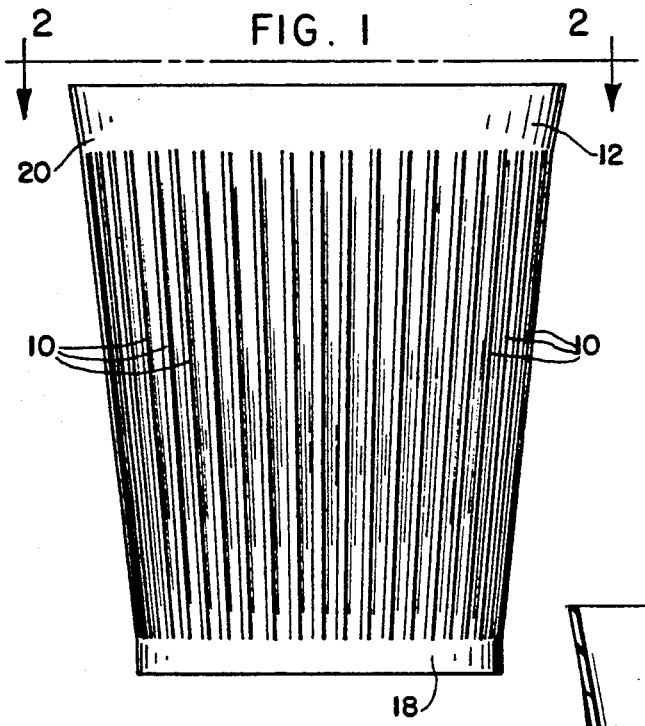
FIG. 1 is an elevational view of the container; all elevational views of the container being the same.
Figure 2:
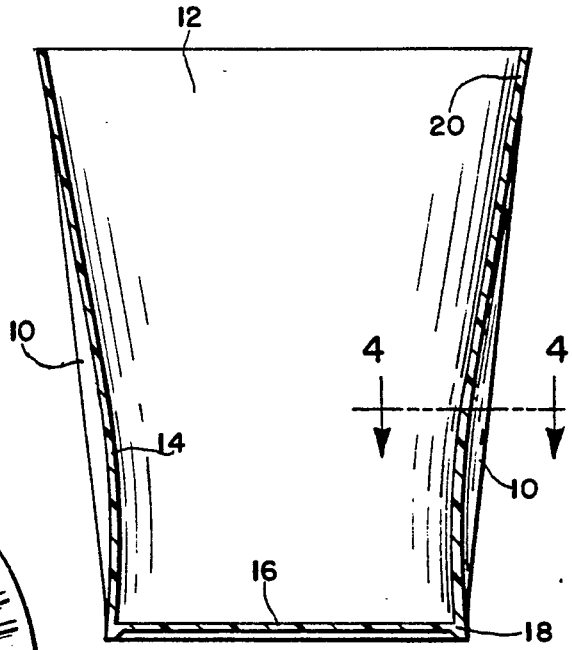
FIG. 2 is a sectional view taken on line 2—2 of FIG. 1, line 2—2 being diametrical of the container.
Figure 3:
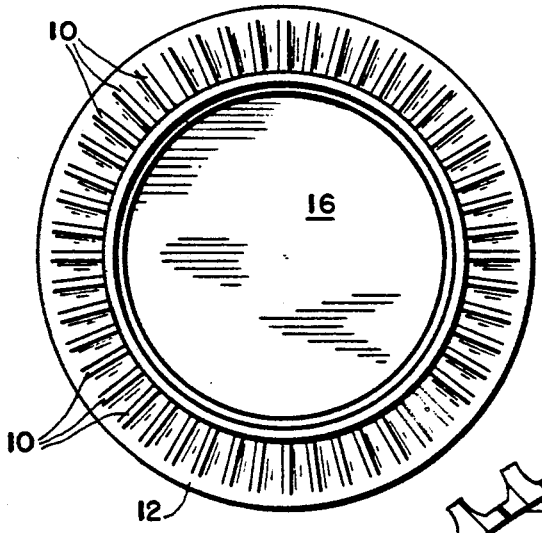
FIG. 3 is a bottom plan view thereof.
Figure 4:
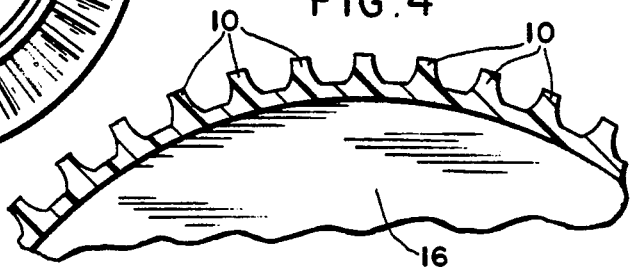
FIG. 4 is a partial sectional view taken on line 4—4 of FIG. 2 and on a larger scale to show the sectional view of the ribs.

The ribs are all of equal thickness and are somewhat triangular in cross section, see FIGS. 1, 2, and 4, and they have blunt outside, terminal edges, for additional comfort to the user. In any event, the higher heat or cold of the contents is at least partially drawn away into the atmosphere and makes the receptacle or container more comfortably handled.

I claim:

1. A container in the form of a tumbler or cup of molded plastic material comprising a receptacle having an integral closed bottom and a continuous side wall rising from the closed bottom and terminating in an open top, said side all having inner and outer sides, a plurality of integral ribs on the wall at the outer side thereof and extending from adjacent the top in circumferentially mutually spaced relation substantially the full area of the wall, said ribs varying in depth along their length, such ribs being substantially identical, said ribs being of maximum depth intermediate ends thereof, and the side wall of the tumbler being convex at its inner aspect and concave at its outer aspect.

2. The container of claim 1 wherein the ribs are generally straight at outer edges thereof.

3. The container of claim 1 wherein bases of the ribs on the outer aspect of the side wall are spaced.

* * * * *